US005850240A

United States Patent [19]

Kubatzki et al.

[11] Patent Number: 5,850,240

[45] Date of Patent: Dec. 15, 1998

[54] ARRANGEMENT FOR AN INK-JET PRINTER HEAD COMPOSED OF INDIVIDUAL INK PRINTER MODULES

[75] Inventors: Ralf Kubatzki; Wolfgang Thiel; Junming Zhang, all of Berlin, Germany

[73] Assignee: Francotyp-Postalia GmbH, Birkenwerder, Germany

[21] Appl. No.: 555,142

[22] Filed: Nov. 8, 1995

[30] Foreign Application Priority Data

Nov. 25, 1994 [DE] Germany ..... 44 43 254.2

[51] Int. Cl.[6] ..... B41J 2/14

[52] U.S. Cl. ..... 347/49; 347/71

[58] Field of Search ..... 347/49, 40, 42, 347/50, 71, 70, 68, 20

[56] References Cited

U.S. PATENT DOCUMENTS

| | | | |
|---|---|---|---|
| 3,988,745 | 10/1976 | Sultan | 347/71 |
| 4,703,333 | 10/1987 | Hubbard . | |
| 5,148,194 | 9/1992 | Asai et al. | 347/49 |
| 5,446,484 | 8/1995 | Hoisington et al. | 347/68 |
| 5,592,203 | 1/1997 | Thiel et al. . | |

FOREIGN PATENT DOCUMENTS

| | | | |
|---|---|---|---|
| 0 486 256 | 5/1992 | European Pat. Off. . | |
| 4230292 | 3/1974 | Germany | 347/68 |
| 42 25 799 | 2/1994 | Germany . | |
| 94 04 328 U | 6/1994 | Germany . | |
| 59-89166 | 5/1984 | Japan | 347/68 |
| 63-37957 | 2/1988 | Japan | 347/40 |
| 3-166953 | 7/1991 | Japan | 347/68 |
| 3-234538 | 10/1991 | Japan | 347/68 |
| 4-7156 | 1/1992 | Japan | 347/70 |
| 5-96724 | 4/1993 | Japan | 347/68 |
| 5-269995 | 10/1993 | Japan | 347/71 |

*Primary Examiner*—Nancy Le
*Assistant Examiner*—Judy Nguyen
*Attorney, Agent, or Firm*—Hill & Simpson

[57] ABSTRACT

An ink-jet printer head is composed of stacked ink printer modules operating according to the edge-shooter principle and each equipped with plate-shaped piezoelectric actuators. The ink-jet printer head is for use in small, fast printers, suitable for use in a franking machine wherein a large number of nozzles are required. Plate-shaped spacer parts between the ink printer modules are structured such that they serve both for assuring the required spacing between neighboring modules as well as for setting an offset of the nozzle apertures of the neighboring ink printer modules relative to one another. To that end, the spacer parts are provided with registration elements at both sides that engage into allocated recesses of the ink printer modules. Each ink printer module also has electrical interconnects for connection to a driver circuit. In order to suffice with only one connector array for connection to the driver circuit, interconnects are extended, for each module, from its outer diaphragm plate surface over the lateral surfaces of the module into its other outer diaphragm plate surface.

28 Claims, 4 Drawing Sheets

ARRANGEMENT FOR AN INK-JET PRINTER HEAD COMPOSED OF INDIVIDUAL INK PRINTER MODULES

BACKGROUND OF THE INVENTION

1. Field of the Invention

The invention is directed to an arrangement for an ink-jet printer head of the type composed of ink printer modules in stacked fashion and operating according to the edge-shooter principle, and that are equipped with plate-shaped piezoelectric actuators.

2. Description of the Prior Art

Ink-jet printer heads of the above type are used in small, fast printers that are in turn a component of modern machines for franking postal matter or for printing addresses. Such a printer is also suitable for product labelling.

Differing from standard office printers which undertake line-by-line printing, in the above type of units printing ensues as a one-time franking imprint in a single pass of the postal matter. Due to this significantly greater printing width—approximately an inch—the number of ink nozzles to be arranged under one another, and thus the number of piezo-actuators, is substantially greater in such an ink-jet printer head than in a standard ink-jet printer head for office printers.

Printer resolutions of approximately 200 dpi are required in order to satisfy the needs of many customers—imprints with word and image characters—for postage meter machines with good printing quality; this requires ink-jet printer heads having the same number of nozzles and piezo-actuators, given a printing width of one inch. The standard nozzle apertures lie between 40 through 50 $\mu$m in width. Given an imprint width of one inch and a resolution of 200 dpi, adjustment errors (tolerance build-up) must be kept below 10 $\mu$m.

Such ink-jet printer heads are necessarily produced with modules arranged in a planar or stacked fashion, first for reasons of permissible dimensions and the packing density that can thereby be achieved, and second for reasons of economical manufacture, see German OS 42 25 799. Planar resonators are thereby usually utilized as piezo-actuators, with a piezoelectric material, for example lead-zirconate-titanate (PZT), arranged between two metal electrodes. The carrier plate—which simultaneously serves as the diaphragm plate over the ink printer chambers—for the piezo-actuators can be composed of glass, ceramic, plastic or metal.

The manner of arranging the modules relative to one another in order to achieve a printing density of 200 dpi and the contacting of the piezo-actuators are thus a critical problem.

German OS 42 25 799 discloses an ink-jet printer head of the general type initially described above that is composed of a number of different modules of which only a module disposed at the outside or in the middle of the stack carries the common nozzle row at its face end. Each module is composed of a middle plate and diaphragm plates arranged at both sides thereof. The ink pressure chambers lie between the diaphragm plates and the middle plate. All modules have ink printer pressure chambers drivable by piezo-actuators for ink ejection that are connected to the allocated nozzles via correspondingly conducted channels. The connecting channels from module to module necessarily proceed orthogonally relative to the pressure chambers.

Spacer parts that each have an ink delivery aperture and ink passage apertures as well as a recess for the piezo-actuators are arranged between the modules. The spacer parts can be of one piece or two-piece and are composed of the same material as the piezo-actuators, which are arranged on the outside wall of the ink pressure chambers and are contacted to electrical interconnects proceeding to that location.

Even though the advantage of only a single nozzle row is significant, the technological outlay for manufacturing modules which differ from one another is still considerable.

A higher precision than for the ink pressure chambers and a greater attention to precise adjustment are required for the connecting channels proceeding through a number of modules. The connecting channels of different lengths entail additional electronic control measures. When an individual module malfunctions, the complicated assembly and adjustment precludes its individual replacement and, consequently, a replacement of the complete ink-jet printer head is required. Due to the large number of nozzles, these heads are significantly more expensive than ink-jet printer heads for standard office printers.

European Application 0 486 256 also discloses a printer head for an ink-jet printer that is composed of a number of plates in stacked fashion. The ink pressure chambers and nozzle channels as well as the nozzle apertures are worked into piezoelectric plates in the form of recesses. Operation ensues according to the shear mode principle. In order to achieve an offset of the nozzle apertures relative to one another, the nozzle region of each chamber plate is offset by the required dimension compared to the nozzle region of the preceding chamber plate in the stack. This means a corresponding manufacturing outlay since each chamber plate must be differently worked. The nature of the drive is also problematical with respect to acoustic decoupling and achieving a durable, tight connection between the individual plates.

German Utility Model 94 04 328 also discloses an ink-jet printer head that is composed of two outer, smooth diaphragm plates and a structured middle plate. The ink chambers and the ink channels are formed in the middle plate at both sides; the nozzle lie in a row at only one side of the middle plate, analogous to the ink intake spaces. To this end, the middle plate has vertical and horizontal ink channels. Piezo actuators are arranged on the diaphragm plates in the regions above the ink chambers. The ink chambers and the ink intake spaces are fashioned broader and deeper than the horizontal ink chambers. Consequently, recesses that are flat, deep and continuous must be achieved. This requires a corresponding technical outlay, particularly since the recesses of both sides must be made to match (be in registry) with one another. The piezo-actuators are provided with electrodes at both sides such that the outer electrode only partially covers the piezo-plate and the inner electrode projects somewhat beyond it. Moreover, this known arrangement cannot be arbitrarily modified to accommodate more nozzles because an increase in the number of nozzles necessarily results in an enlargement of the width and length of the printer head.

Finally, U.S. Pat. No. 4,703,333 discloses an ink-jet printer head wherein a number of ink printer modules operating according to the side-shooter principle are stacked in an inclined manner following one another so that the nozzle region as well as the ink supply region are free. A receptacle frame having slanting steps is matched to this fishscale-like arrangement. In order to achieve the lateral offset of the nozzles relative to one another, the ink printer modules are provided with oblong holes through which screws that engage threaded holes of the steps are conducted. The modules must be adjusted with a template and then be locked in place with the screws. The individual ink printer module is composed of a nozzle plate, an ink channel plate, a pressure chamber plate, a diaphragm plate with piezo-actuators and a over plate with a recess for a ribbon conductor for contacting the piezo actuators. An ink delivery channel with two ink connection sockets is worked into the cover plate.

A replacement of individual ink printer modules is possible in this known printer head, but only by unsoldering the ribbon conductor, and, as may be seen from the specification thereof, the number of discrete parts and the adjustment outlay are considerable. Moreover, the cleaning and sealing station adapted to this ink-jet printer had will have a very complicated structure because of the stepping.

SUMMARY OF THE INVENTION

Simplification of the ink-jet printer head structure and an improvement of the service properties are objects of the present invention.

The invention is more particularly based on the object of creating an arrangement for an ink-jet printer head wherein the ink printer modules can be easily replaced, the number of different component parts is reduced, and adjustment outlay is largely avoided.

The above object is achieved in accordance with the principles of the present invention in an ink-jet printer head operating according to the edge-shooter principle composed of a number of identical ink printer modules, arranged in a stack with a spacer part between neighboring modules. The spacer parts between neighboring ink printer modules serve the dual functions of assuring the required spacing between the modules in a first direction and setting an offset of the ink printer modules, i.e., the nozzle apertures thereof, relative to each other in a second direction substantially perpendicular to the first direction, in order to achieve the desired density. For that purpose, each spacer part is provided with registration elements on opposite sides thereof which respectively mechanically engage recesses in the ink printer module adjacent thereto. Moreover, each ink printer module has interconnections to a driver circuit for the piezo-actuators of that module. In order to suffice with only one connector array for connection to the driver circuit, interconnects are extended, for each module, from its outer diaphragm plate surface over the lateral surfaces of the module onto its outer diaphragm plate surface.

In one embodiment, the driver circuit can be mounted on one of the diaphragm plates of the module, the driver circuit being electrically connected to all of the conductor runs forming the interconnects array, and a plug-type connector being provided at a rear of the module. In another embodiment, the conductor forming the connector array can extend directly to a rear of the module, and the driver circuit can be disposed elsewhere and electrically connected thereto.

A number of advantages are achieved as a result of the solution disclosed herein.

Since the spacer part is inventively utilized both as a spacer and as an adjustment member for the ink printer modules, complicated housings and front masks can be omitted.

The nozzle row which is offset for achieving the desired printing density is realized exclusively with the registration elements of the spacer parts; the ink printer modules can thus be constructed absolutely identical. For example, the offset from module to module given three ink printer modules amounts to one-third of the nozzle aperture spacing of a module.

Since the recesses for the registration elements in the ink printer modules are always extended into the nozzle plane in terms of depth, an exact spacing of the nozzle plane in terms of depth, an exact spacing of the nozzle planes of the ink printer modules relative to one another is assured. The spacing between two nozzle planes is exclusively determined by the spacing of the cover surfaces of registration elements of a spacer part that are oppositely directed.

The recesses in the ink printer modules can already be introduced during manufacture of the individual plates of the module by laser etching or punching. The registration elements can already be formed by appropriate thickening and shaping in the manufacture, i.e., casting, of the spacer parts composed of ceramic material. The casting or compression mold merely has to be appropriately shaped.

If the driver circuits for the piezo-actuators are also accommodated on the ink printer modules and these are provided with plug-type connectors, an especially easy replacement of the modules is possible and, moreover, individual modules that can be easily tested are obtained. This allows an effective testing during the manufacturing process—thus an increase in the yield rate of the ink-jet printer head fabrication—and improved service. This is of significance, particularly since the ink-jet printer modules, with their many nozzle apertures, are still costly components.

Since the electrical interconnects from one outer diaphragm plate, surface on the other outer diaphragm plate surface of an ink printer module are conducted over the lateral faces thereof, only one driver circuit and only one plug connector is required per ink printer module.

It is also possible, however, to eliminate the plug connectors and to integrate the driver circuits into the lead cable and/or into the external drive electronics.

Due to the one-piece, chamber-like embodiment and the inclusion of all electrodes in one plane, the assembly and contacting of the piezo-actuators is simplified. The contacting can ensue using a printed circuit technique with a solder having a low melting point, for instance indium, or with bonding bridges (wires or jumpers). In the former instance, all electrodes of the piezo-actuators face toward the interconnects.

It is also possible to individually apply the piezo-actuators in a conventional way. Expediently, the electrodes that face toward the diaphragm plates are then connected to one another with a common interconnect.

DESCRIPTION OF THE PREFERRED EMBODIMENTS

All of the figures are schematically drawn to facilitate understanding.

Figure 1:
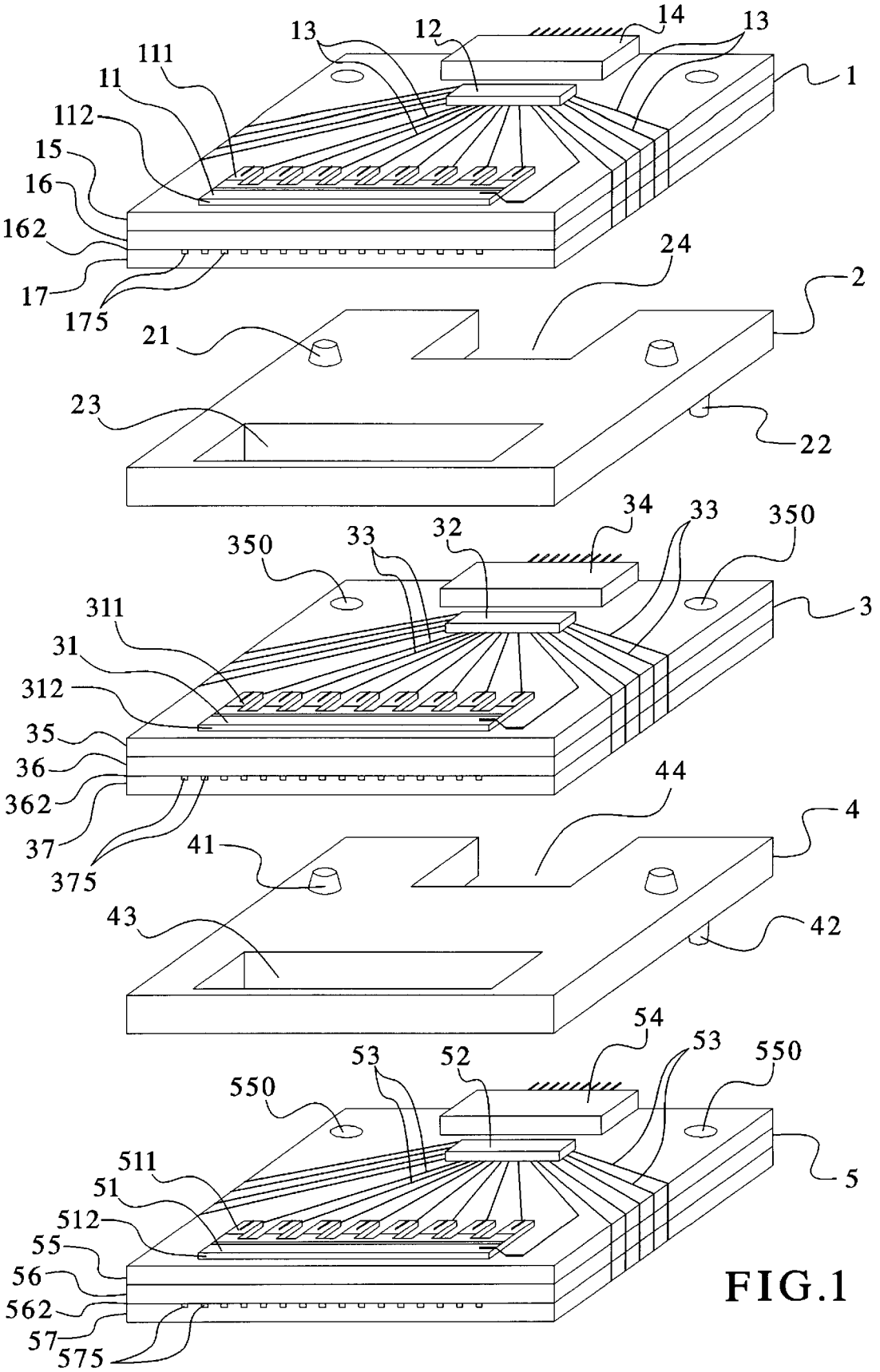
FIG. 1 is an exploded view of an ink-jet printer head composed of three ink printer modules constructed in accordance with the principles of the present invention.

As shown in FIG. 1, an ink-jet printer head is composed of three identical ink printer modules 1,3 and 5 and two, likewise identical spacer parts 2 and 4 respectively arranged between them.

The first ink printer module 1 is composed of a first cover plate 15, a middle plate 16 and a second cover plate 17. The plates can be connected to one another by gluing or thermal diffusion bonding.

Figure 3A:
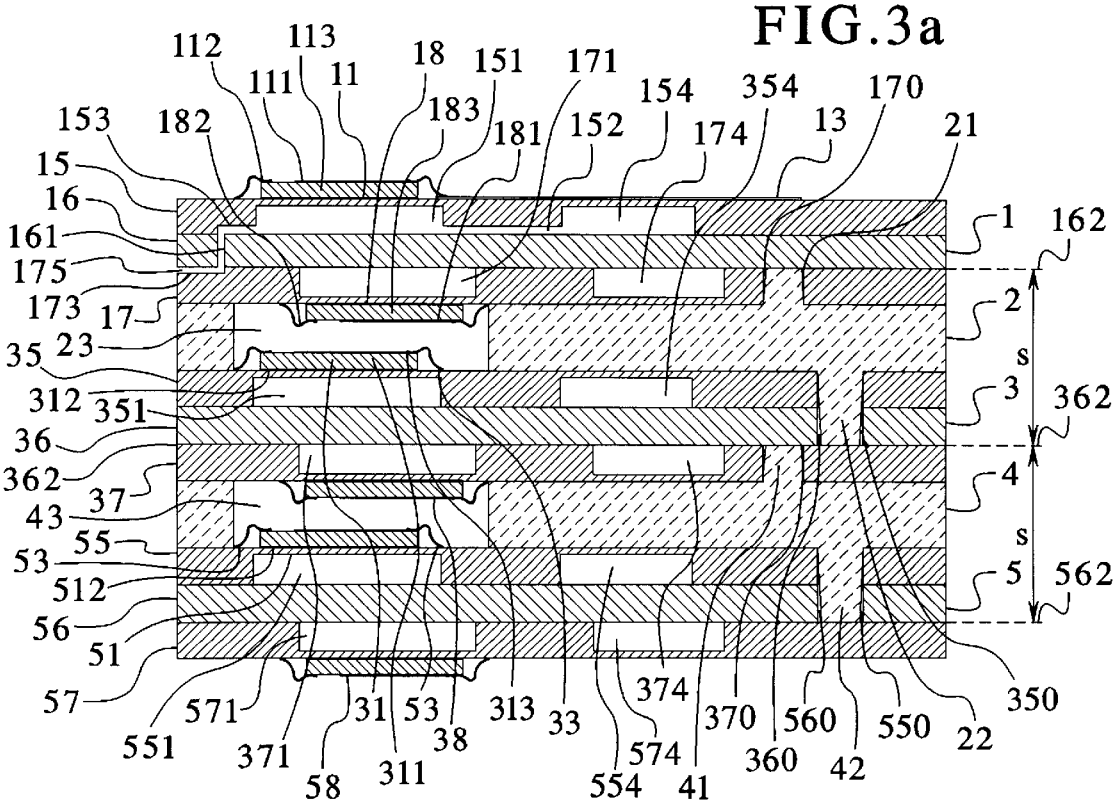
FIG. 3*a* is a sectional view taken along line AA' of FIG. 2.
Figure 3B:
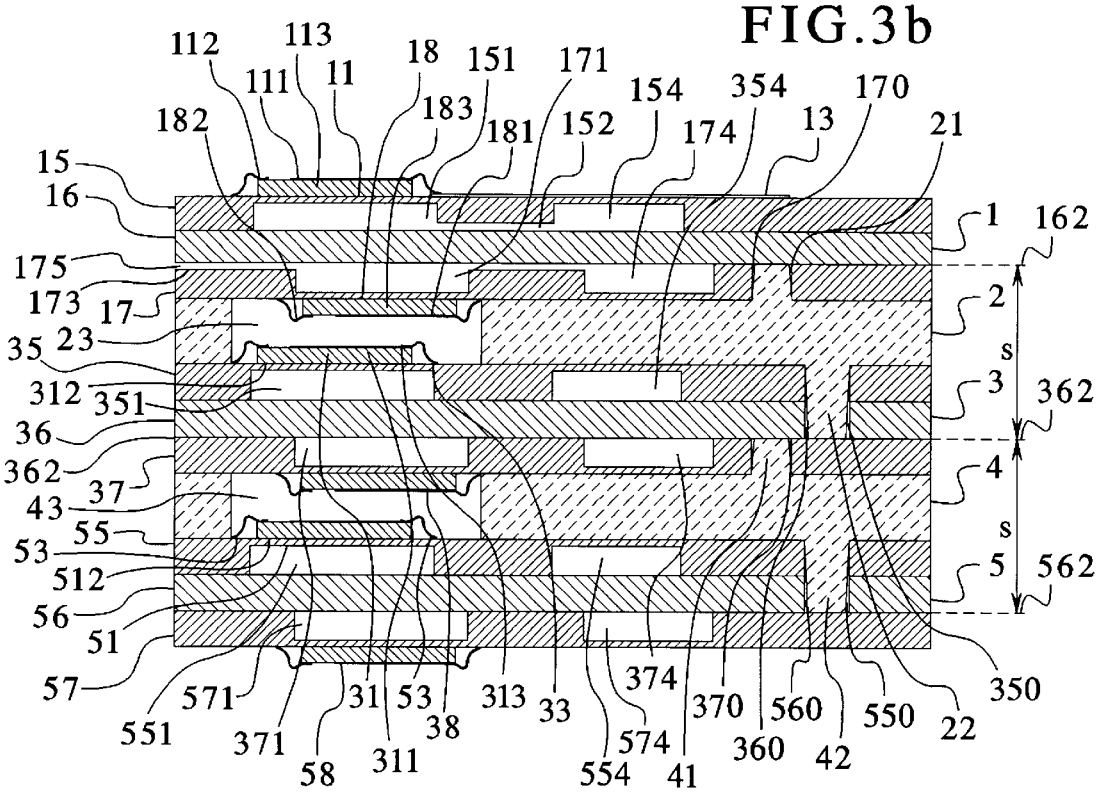
FIG. 3*b* is a sectional view taken along line BB' of FIG. 2.

In the respective surface of cover plates 15 and 17 facing toward the middle plate 16, ink pressure chambers 151 and 171, ink channels 152 and 172, nozzle channels 153 and 173 as well as ink delivery channels 154 and 174 are respectively disposed (also see FIGS. 3*a* and 3*b*).

All nozzle apertures 175 of the ink printer module 1 proceed in a row in the second cover plate 17. To this end, the nozzle channels 153 are conducted from the first cover plate 15 through the middle plate 16 as nozzle channels 161 and then continue up to the nozzle channels 173 in the second cover plate 17, ending in the cover plate 17 as the nozzle apertures 175.

In the example described herein, sixteen nozzle apertures 175, 375 and 575 are provided per ink printer module 1,3 and 5. A real module, however, will have 64 nozzle apertures.

Respective piezo-actuators 11 and 18 are put in place on the outside surfaces of the cover plates 15 and 17 in the region over the respective ink pressure chambers 151 and 171, with one piezo-actuator over each ink pressure chamber. The cover plates 15 and 17 are necessarily thinner in the regions over the ink pressure chambers 151 and 171 and act as a diaphragm for the pressure chamber in registry therewith. The designation 'diaphragm plate' is therefore also applicable for the cover plates. An alternative would be to fashion the cover plates as thin, smooth diaphragm plates and to displace all structures into the middle plate 16.

The respective ink pressure chambers 151 and 171 in the respective cover plates 15 and 17 lead to alternating nozzle apertures 175. In other words, given the orientation shown in FIG. 1, the left-most nozzle aperture 175 will be connected to the left-most ink pressure chamber 151 in the cover plate 15, and the immediately adjacent nozzle aperture 175 will be connected to the left-most ink pressure chamber 171 in the cover plate 17, and so on in alternating fashion.

Figure 5:
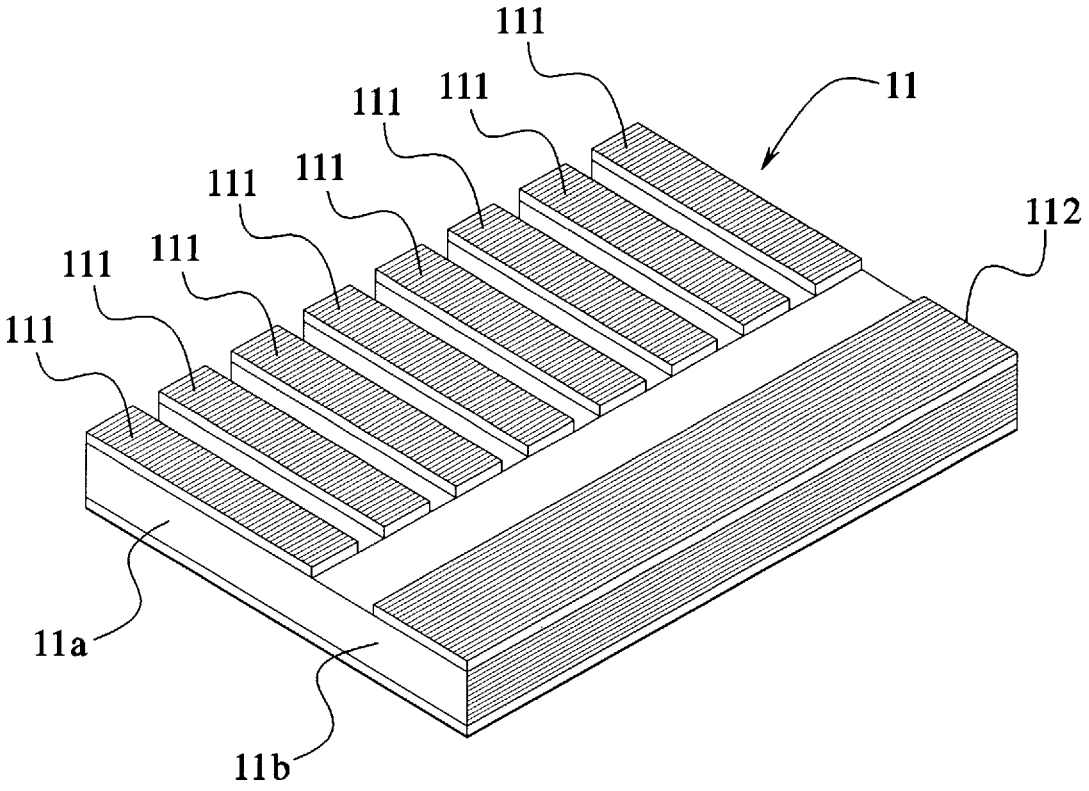
FIG. 5 is a perspective view showing, as an example, one of the piezo-actuators.

For facilitating manufacture, assembly and contacting, the piezo actuators 11 and 18 are in the form of a comb whose spine is fashioned as an inactive (i.e., unactuatable) region and whose teeth are fashioned as an active region of respective piezo-layers 113 and 183. Each tooth represents an individual piezo-actuator whose base surface and top surface are respectively covered with electrodes 111, 112, 181 and 182. As a shared electrode for all piezo-actuators 11 and 18, electrode 112 each and 182, respectively, is extended over and face end or over the comb spine into the inactive region of the opposite side. As a result, electrical contacting can ensue from one side or in a printed circuit technique. The piezo-actuator 11 is shown in FIG. 5, with all of the other piezo-actuators being identical thereto. The piezo-actuator 11 is divided into an active region 11*a* between electrodes 111 and 112, and an inactive region 11*b*, covered only by electrode 112. Because the piezo-actuators 11 and 18 are united as one component as well as being spaced from one another at the chamber spacing, a complicated individual application and alignment over the ink pressure chambers 151 as 171 is avoided, i.e., alignment automatically ensues. The component can be glued on as a whole over previously applied masking marks.

The electrodes 111, 112, 181 and 182 are electrically contacted via bonding bridges to allocated interconnects 13 that proceed on the surfaces of the cover plates 15 and 17.

Driver circuits 12 for the piezo actuators 11 and 18 are applied on the first cover plate 15 in the form of a module and are likewise contacted to the interconnects 13.

In order to provide an easily releasable connection to the rest of the printer electronics, a plug-type connector 14 is also secured and contacted on the cover plate 15. In order to suffice with only one plug-type connector 14 and one driver circuit module 12 per ink printer module, the interconnects 13 are extended around from the second cover plate 17 over both lateral surfaces (side edges) of the ink printer module 1 into the surface of the first cover plate 15.

Figure 2:
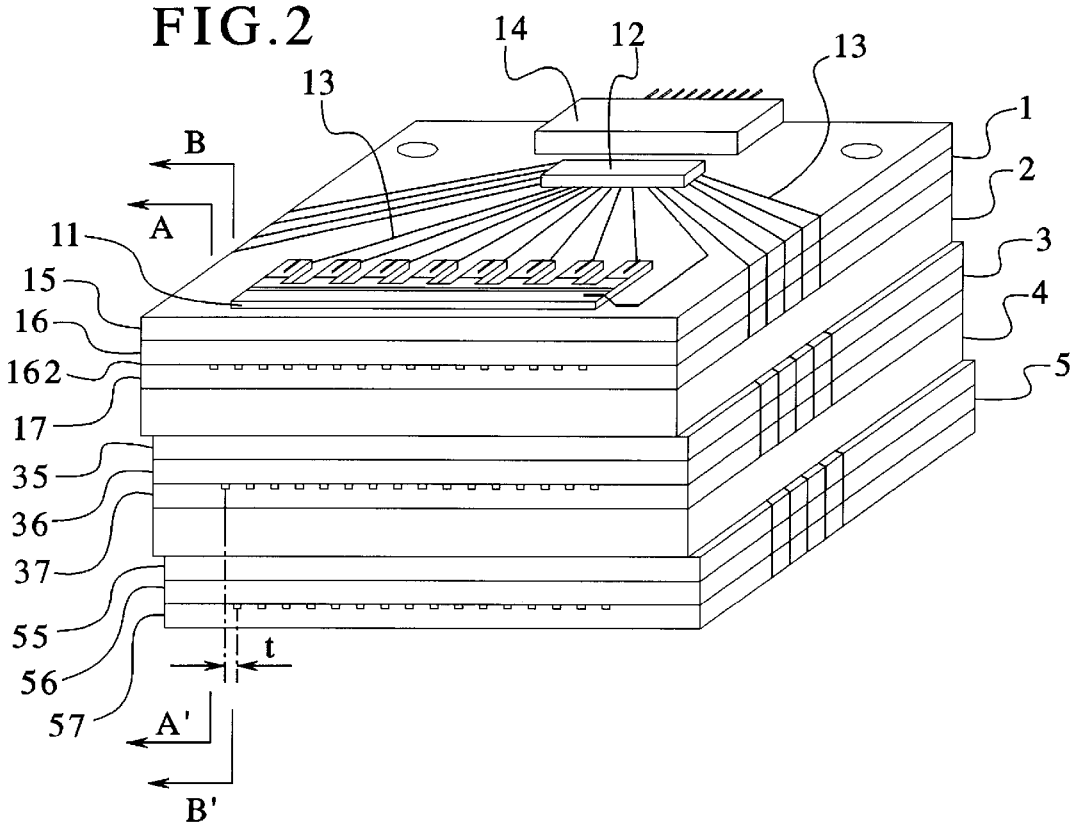
FIG. 2 is a perspective view of the assembled ink-jet printer head of FIG. 1.

The spacer part 2 is fashioned and arranged between the ink printer modules 1 and 3 such that it aligns with the first ink printer module 1 and is offset from the second ink printer module 3 by the printing density dimension t (for example, 192 drops per inch), (also see FIG. 2). The thickness of the spacer part is dimensioned such that an adequately large spacing exists between the two ink printer modules 1 and 3 with their components in place thereon. The spacer part 2 is provided with respective registration elements 21 and 22 at both sides that engage into allocated, matched recesses 170, 350 and 360 of the ink printer modules 1 and 3, (also see FIGS. 3*a* and 3*b*).

In the example, the spacer part 2 is shown with two pairs of registration elements 21 and 22 for a simpler illustration; in the practical realization, there will preferably be three pairs. Two of the recesses are then fashioned as oblong holes and one recess is fashioned as a cylindrical hole. The outermost surface of the registration element 21 in the ink printer module 1 lies against the nozzle plane 162. The outermost surface of the registration element 22 in the ink printer module 3 lies against the nozzle plane 376. The parallel spacing of the outermost surfaces of the opposing registration elements 21 and 22 is equal to the required spacing s of the nozzle planes 162 and 376 from one another. The plate thickness of the spacer part 2, accordingly, is dimensioned such that the required spacing is defined exclusively by the registration elements 21 and 22.

Compared to the registration element 22, the registration element 21 is shorter by one thickness of the middle plate since it only penetrates the cover plate 17 in the recess 170.

The registration element 22 penetrates the cover plate 35 in the recess 350 and the middle plate 36 in the recess 360. With reference to a defined lateral edge of the ink printer module 3, the recesses 350 and 360 are offset farther toward the inside by the printing density dimension t than is the registration element 22 at the spacer part 2. In this way, the first nozzle aperture 375 of the ink printer module 3 is offset by the printing density dimension t relative to the first nozzle aperture 175 of the ink printer module 1, as are, correspondingly, the other nozzle apertures.

The spacer part 2 is provided with a recess 23 for the piezo actuators 18 and 31 as well as with a recess 24 for the driver circuits 32 and the plug-type connector 34.

Since the section AA' according to FIG. 2 is conducted through the outermost nozzle 175 of the first ink printer module 1, in view according to FIG. 3*a* only the connection from the ink delivery channel 154 via the ink channel 152 to the ink pressure chamber 151, the nozzle channel 153, the nozzle channel 161, the nozzle channel 173 and up to the nozzle aperture 175 are visible. The ink delivery channels 154 and 174 respectively proceed orthogonally relative to the ink channels 152 and 172 and parallel to the nozzle aperture row 175.

Figure 4:
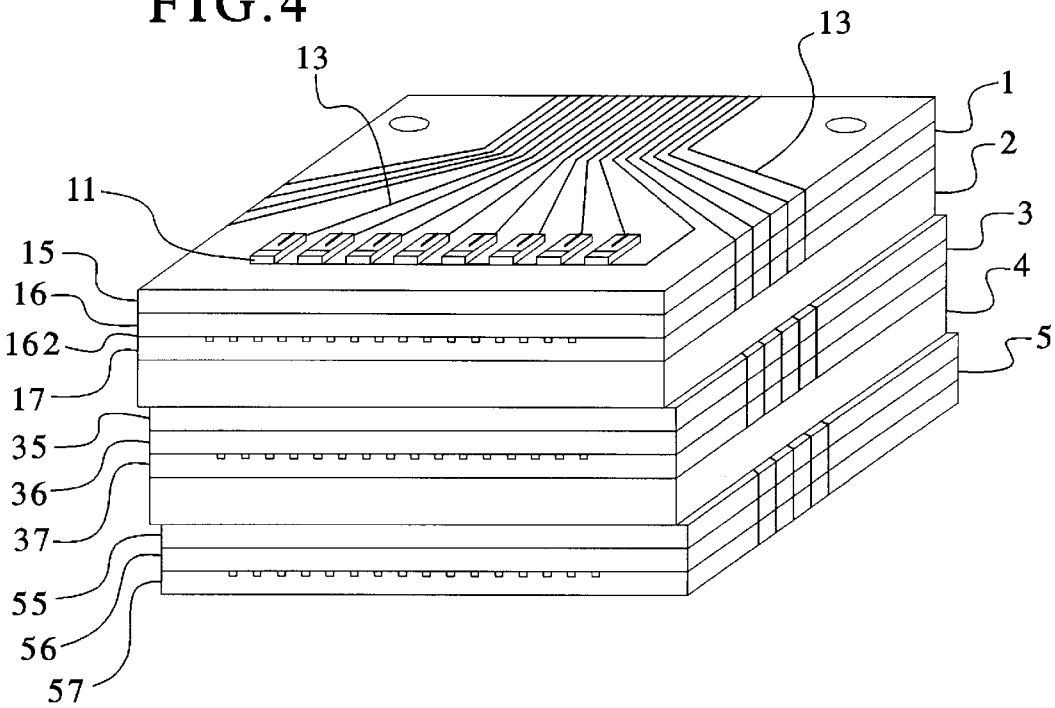
FIG. 4 is a perspective view of an ink-jet printer head constructed in accordance with the principles of the present invention with an external drive.

FIG. 4 shows an embodiment wherein a plug-type connector has been omitted and the driver circuits lie externally, for example integrated in a ribbon conductor. Additionally, the possibility of separate application of individual piezo actuators is shown.

The structure of the other modules 3 and 5 is identical to that described in detail above for the module 1, with the respective components for the module 3 having the same reference numerals as described above for the module of FIG. 1, but with a first digit "3" replacing the first digit "1" and the reference numerals for the module 5 have a first digit "5" instead of "1".

Since all of the ink printer modules 1, 3 and 5 are identically constructed and the spacer parts 2 and 4 are likewise identically constructed, a stacking of ink printer modules is possible in the desired way, whereby equidistance and side offset of the nozzle rows are assured.

Although modifications and changes may be suggested by those skilled in the art, it is the intention of the inventors to embody within the patent warranted hereon all changes and modifications as reasonably and properly come within the scope of their contribution to the art.

We claim as our invention:

1. An ink-jet printer head comprising:

a plurality of identical ink printer modules each of said ink printer modules comprising first and second cover plates and at least one middle plate therebetween, said first and second cover plates each having a first side adjoining said middle plate and a second, opposite side, said first and second cover plates and said middle plate each having lateral sides and nozzle channels wherein one of said nozzle channels of each of said cover plates and middle plate are connected together to form one continuous channel, said cover plates each having ink pressure chambers, said one continuous channel having a first end terminated in one of nozzle apertures formed in one of said cover plates and a second end connected to one of said ink pressure chambers of another of said cover plates, said nozzle apertures disposed in a single nozzle plane, said second side of each of said cover plates having a plurality of piezo-actuators disposed thereon, each of said piezo-actuators respectively in registry with each of said ink pressure chambers, each of said ink printer modules having a first plurality of electrical interconnects and a second plurality of electrical interconnects, said first plurality of electrical interconnects respectively connected to said piezo-actuators of one of said cover plates, said second plurality of electrical interconnects respectively connected to said piezo-actuators of another of said cover plates, each of said second plurality of electrical interconnects extended from said second side of said one of said cover plates over a corresponding side of said lateral sides of each cover plates and middle plate onto the second side of said other of said cover plates;

a plurality of spacers respectively disposed between said ink printer modules to form a stack of alternating ink printer modules and spacers, each of said spacers having two of said ink printer modules arranged adjacent thereto so as to form two adjoining ink printer modules, each of said spacers having a dimension for setting a desired spacing in a first direction, extending perpendicularly between the respective nozzle planes in said two adjoining ink printer modules, each of said spacers having a mating structure mating with said two adjoining ink printer modules in a manner to offset said two adjoining ink printer modules relative to one another by an offset distance in a second direction substantially perpendicular to said first direction;

wherein each of the piezo-actuators on each of said cover plates has an active region and a common inactive region shared by all of said piezo-actuators of said each of said cover plates, said active region has two electrodes, one of said electrodes connected to a corresponding interconnect of said first interconnects and said second interconnects, said inactive region having only one of said two electrodes;

wherein each of said ink printer modules further comprises a driver circuit electrically connected to said first plurality of interconnects and said second plurality of interconnects; and wherein said driver circuit has a plug electrically connected thereto and exposed at an exterior of said each ink printer module.

2. An ink-jet printer head as claimed in claim 1 wherein said each of said spacers comprises a first side and an opposite second side, said mating structure comprises at least one registration element on each of said sides of said each spacer and wherein each of said two adjoining ink printer modules has a corresponding number of at least one recess therein into which said at least one registration element respectively engage.

3. An ink-jet printer head as claimed in claim 2 wherein said at least one registration element on each of said sides of said each spacer has an outermost surface on a plane that is coplanar with one of said respective nozzle planes of the adjoining ink printer modules and a spacing between said planes of said outermost surfaces is equal to said desired spacing in said first direction.

4. An ink-jet printer head as claimed in claim 2 wherein the respective registration elements on opposite sides of said each spacer are disposed respectively different distances from the respective lateral sides of said two adjoining ink-printer modules with a difference between said respective distances being equal to said offset distance in said second direction.

5. An ink-jet printer head as claimed in claim 1 wherein said each of said spacers has a plurality of recesses therein in registry with and containing the piezo-actuators and the driver circuit of one of said cover plates of one of said two adjoining ink-printer modules.

6. An ink-jet printer head as claimed in claim 1 wherein said each of said spacers comprises a ceramic plate.

7. An ink-jet printer head as claimed in claim 1 wherein the piezo-actuators on said second side of said each cover plate comprise a unitary, comb shaped component.

8. An ink-jet printer head comprising:

a plurality of identical ink printer modules each of said ink printer modules comprising first and second cover plates and at least one middle plate therebetween, said first and second cover plates each having a first side adjoining said middle plate and a second, opposite side, said first and second cover plates and said middle plate each having lateral sides and nozzle channels wherein one of said nozzle channels of each of said cover plates and middle plate are connected together to form one continuous channel, said cover plates each having ink pressure chambers, said one continuous channel having a first end terminated in one of nozzle apertures formed in one of said cover plates and a second end connected to one of said ink pressure chambers of another of said cover plates, said nozzle apertures disposed in a single nozzle plane, said second side of each of said cover plates having a plurality of piezo-actuators disposed thereon, each of said piezo-actuators respectively in registry with each of said ink pressure chambers, each of said ink printer modules having a first plurality of electrical interconnects and a second plurality of electrical interconnects, said first plurality of electrical interconnects respectively connected to said piezo-actuators of one of said cover plates, said second plurality of electrical interconnects respectively connected to said piezo-actuators of another of said cover plates, each of said second plurality of electrical interconnects extended from said second side of said one of said cover plates over a corresponding side of said lateral sides of each cover plates and middle plate onto the second side of said other of said cover plates;

a plurality of spacers respectively disposed between said ink printer modules to form a stack of alternating ink printer modules and spacers, each of said spacers having two of said ink printer modules arranged adjacent thereto so as to form two adjoining ink printer modules, each of said spacers having a dimension for setting a desired spacing in a first direction, extending perpendicularly between the respective nozzle planes in said two adjoining ink printer modules, each of said spacers having a mating structure mating with said two adjoining ink printer modules in a manner to offset said two adjoining ink printer modules relative to one another by an offset distance in a second direction substantially perpendicular to said first direction; and wherein each of the piezo-actuators on each of said cover plates has an active region and a common inactive region shared by all of said piezo-actuators of said each of said cover plates, said active region has two electrodes, one of said electrodes connected to a corresponding interconnect of said first interconnects and said second interconnects, said inactive region having only one of said two electrodes.

9. An ink-jet printer head as claimed in claim 8 wherein said each of said spacers comprises a first side and an opposite second side, said mating structure comprises at least one registration element on each of said sides of said each spacer and wherein each of said two adjoining ink printer modules has a corresponding number of at least one recess therein into which said at least one registration element respectively engage.

10. An ink-jet printer head as claimed in claim 9 wherein said at least one registration element on each of said sides of said each spacer has an outermost surface on a plane that is coplanar with one of said respective nozzle planes of the adjoining ink printer modules and a spacing between said planes of said outermost surfaces is equal to said desired spacing in said first direction.

11. An ink-jet printer head as claimed in claim 9 wherein the respective registration elements on opposite sides of said each spacer are disposed respectively different distances from the respective lateral sides of said two adjoining ink-printer modules with a difference between said respective distances being equal to said offset distance in said second direction.

12. An ink-jet printer head as claimed in claim 8 wherein said each of said spacers has a recess therein in registry with and containing the piezo-actuators of one of said cover plates of each of said two adjoining ink-printer modules.

13. An ink-jet printer head as claimed in claim 8 wherein said each of said spacers comprises a ceramic plate.

14. An ink-jet printer head as claimed in claim 8 wherein the piezo-actuators on said second side of said each cover plate comprise a unitary, comb shaped component.

15. An ink-jet printer head comprising:

a plurality of identical ink printer modules each of said ink printer modules comprising first and second cover plates and at least one middle plate therebetween, said first and second cover plates each having a first side adjoining said middle plate and a second, opposite side, said first and second cover plates and said middle plate each having lateral sides and nozzle channels wherein one of said nozzle channels of each of said cover plates and middle plate are connected together to form one continuous channel, said cover plates each having ink pressure chambers, said one continuous channel having a first end terminated in one of nozzle apertures formed in one of said cover plates and a second end connected to one of said ink pressure chambers of another of said cover plates, said nozzle apertures disposed in a single nozzle plane, said second side of each of said cover plates having a plurality of piezo-actuators disposed thereon, each of said piezo-actuators respectively in registry with each of said ink pressure chambers, each of said ink printer modules having a first plurality of electrical interconnects and a second plurality of electrical interconnects, said first plurality of electrical interconnects respectively connected to said piezo-actuators of one of said cover plates, said second plurality of electrical interconnects respectively connected to said piezo-actuators of another of said cover plates, each of said second plurality of electrical interconnects extended from said second side of said one of said cover plates over a corresponding side of said lateral sides of each cover plates and middle plate onto the second side of said other of said cover plates each of said ink printer modules including a shared interconnect on said second side of each of said cover plates;

a plurality of spacers respectively disposed between said ink printer modules to form a stack of alternating ink printer modules and spacers, each of said spacers having two of said ink printer modules arranged adjacent thereto so as to form two adjoining ink printer modules, each of said spacers having a dimension for setting a desired spacing in a first direction, extending perpendicularly between the respective nozzle planes in said two adjoining ink printer modules, each of said spacers having a mating structure mating with said two adjoining ink printer modules in a manner to offset said two adjoining ink printer modules relative to one another by an offset distance in a second direction substantially perpendicular to said first direction;

wherein each of said piezo-actuators on each of said cover plates has first and second electrodes with said first electrodes of all of the piezo-actuators on the second side of each of said cover plates being connected to a respective one of said shared interconnects and said second electrodes being respectively connected to a respective plurality of electrical interconnects of said first plurality of electrical interconnects and said second electrical interconnects;

wherein each of said ink printer modules further comprises a driver circuit electrically connected to said first plurality of interconnects and said second plurality of interconnects; and wherein said driver circuit has a plug electrically connected thereto and exposed at an exterior of said each ink printer module.

16. An ink-jet printer head as claimed in claim 15 wherein said each of said spacers comprises a first side and an opposite second side, said mating structure comprises at least one registration element on each of said sides of said each spacer and wherein each of said two adjoining ink printer modules has a corresponding number of at least one recess therein into which said at least one registration element respectively engage.

17. An ink-jet printer head as claimed in claim 16 wherein said at least one registration element on each of said sides of said each spacer has an outermost planar surface on a plane that is coplanar with one of said respective nozzle planes of the adjoining ink printer modules and a spacing between said planes of said outermost surfaces is equal to said desired spacing in said first direction.

18. An ink-jet printer head as claimed in claim 16 wherein the respective registration elements on opposite sides of said each spacer are disposed respectively different distances from the respective lateral sides of said two adjoining ink-printer modules with a difference between said respective distances being equal to said offset distance in said second direction.

19. An ink-jet printer head as claimed in claim 15 wherein said each of said spacers has a plurality of recesses therein in registry with and containing the piezo-actuators and the driver circuit of one of said cover plates one of said two adjoining ink-printer modules.

20. An ink-jet printer head as claimed in claim 15 wherein said each of said spacers comprises a ceramic plate.

21. An ink-jet printer head as claimed in claim 15 wherein the piezo-actuators on said second side of said each cover plate comprise a unitary, comb shaped component.

22. An ink-jet printer head comprising:

a plurality of identical ink printer modules each of said ink printer modules comprising first and second cover plates and at least one middle plate therebetween, said first and second cover plates each having a first side adjoining said middle plate and a second, opposite side, said first and second cover plates and said middle plate each having lateral sides and nozzle channels wherein one of said nozzle channels of each of said cover plates and middle plate are connected together to form one continuous channel, said cover plates each having ink pressure chambers, said one continuous channel having a first end terminated in one of nozzle apertures formed in one of said cover plates and a second end connected to one of said ink pressure chambers of another of said cover plates, said nozzle apertures disposed in a single nozzle plane, said second side of each of said cover plates having a plurality of piezo-actuators disposed thereon, each of said piezo-actuators respectively in registry with each of said ink pressure chambers, each of said ink printer modules having a first plurality of electrical interconnects and a second plurality of electrical interconnects, said first plurality of electrical interconnects respectively connected to said piezo-actuators of one of said cover plates, said second plurality of electrical interconnects respectively connected to said piezo-actuators of another of said cover plates, each of said second plurality of electrical interconnects extended from said second side of said one of said cover plates over a corresponding side of said lateral sides of each cover plates and middle plate onto the second side of said other of said cover plates; and a plurality of spacers respectively disposed between said ink printer modules to form a stack of alternating ink printer modules and spacers, each of said spacers having two of said ink printer modules arranged adjacent thereto so as to form two adjoining ink printer modules, each of said spacers having a dimension for setting a desired spacing in a first direction, extending perpendicularly between the respective nozzle planes in said two adjoining ink printer modules, each of said spacers having a mating structure mating with said two adjoining ink printer modules in a manner to offset said two adjoining ink printer modules relative to one another by an offset distance in a second direction substantially perpendicular to said first direction.

23. An ink-jet printer head as claimed in claim 22 wherein said each of said spacers comprises a first side and an opposite second side, said mating structure comprises at least one registration element on each of said sides of said each spacer and wherein each of said two adjoining ink printer modules has a corresponding number of at least one recess therein into which said at least one registration element respectively engage.

24. An ink-jet printer head as claimed in claim 23 wherein said at least one registration element on each of said sides of said each spacer has an outermost surface on a plane that is coplanar with one of said respective nozzle planes of the adjoining ink printer modules and a spacing between said planes of said outermost surfaces is equal to said desired spacing in said first direction.

25. An ink-jet printer head as claimed in claim 23 wherein the respective registration elements on opposite sides of said each spacer are disposed respectively different distances from the respective lateral sides of said two adjoining ink-printer modules with a difference between said respective distances being equal to said offset distance in said second direction.

26. An ink-jet printer head as claimed in claim 22 wherein said each of said spacers has a recess therein in registry with and containing the piezo-actuators of one of said cover plates of each of said two adjoining ink-printer modules.

27. An ink-jet printer head as claimed in claim 22 wherein said each of said spacers comprises a ceramic plate.

28. An ink-jet printer head as claimed in claim 22 wherein the piezo-actuators on said second side of said each cover plate comprise a unitary, comb shaped component.

* * * * *

UNITED STATES PATENT AND TRADEMARK OFFICE

CERTIFICATE OF CORRECTION

PATENT NO. : 5,850,240

DATED : December 15, 1998

INVENTOR(S) : Kubatzki et al.

It is certified that error appears in the above-indentified patent and that said Letters Patent is hereby corrected as shown below:

Title page, item [73], cancel "Francotyp-Postali GmbH" and substitute —Francotyp-Postalia AG _ Co.— therefor.

Signed and Sealed this

Thirty-first Day of August, 1999

*Attest:*

Q. TODD DICKINSON

*Attesting Officer*

*Acting Commissioner of Patents and Trademarks*